United States Patent [19]

Howard

[11] Patent Number: 4,531,646

[45] Date of Patent: Jul. 30, 1985

[54] PRODUCT DISPLAY RACK

[75] Inventor: Fred Howard, New York, N.Y.

[73] Assignee: Consolidated Foods Corporation, Winston-Salem, N.C.

[21] Appl. No.: 658,311

[22] Filed: Oct. 5, 1984

[51] Int. Cl.[3] ..... A47F 3/06

[52] U.S. Cl. ..... 211/150; 108/6; 211/59.2; 312/42

[58] Field of Search ..... 211/59.2, 150, 168, 211/170, 149; 312/42, 45, 136, 300; 108/6, 7, 8

[56] References Cited

U.S. PATENT DOCUMENTS

| | | | |
|---|---|---|---|
| 2,804,122 | 8/1957 | Baum . | |
| 3,111,915 | 11/1963 | Gray | 108/6 |
| 3,981,511 | 9/1976 | Fostu | 211/150 X |
| 4,067,265 | 1/1978 | Watson | 108/7 |
| 4,191,296 | 3/1980 | Morgan | 211/150 X |

OTHER PUBLICATIONS

Photographs and assembly instructions of Howard Displays, Inc./Dechar Corporation.

*Primary Examiner*—Robert W. Gibson, Jr.
*Attorney, Agent, or Firm*—Charles Y. Lackey; William S. Burden

[57] ABSTRACT

A product display rack having a series of vertically spaced tiltable tray assemblies movable simultaneously between a first inclined position to permit gravity-fed product package loading of the shelves and a second inclined position for display and gravity-fed product package dispensing. The rack includes a hinged header which is automatically displaced upwardly when the tray assemblies are in the first position to provide unobstructed access to the uppermost tray assembly.

9 Claims, 5 Drawing Figures

PRODUCT DISPLAY RACK

BRIEF SUMMARY AND OBJECTS OF THE INVENTION

This invention relates to a product display rack, and more particularly to a rack having a series of shelves tiltable between predetermined limits to permit gravity-fed product package loading and gravity-fed product package display and dispensing.

In an effort to better utilize floor space to display products for sale in variety, food and drug stores over the past several years, a variety of freestanding product display racks have been developed. The racks may be used within the length or run of an existing display aisle or at the end of an aisle. Such displays have a header assembly fixed relative to the display frame side walls. Unless a large amount of space is left between the tiltable upper shelf assembly and the fixed header, the upper tray assembly is not accessible for gravity-fed loading in the inventory position.

The present invention provides for a hinged header which is automatically displaced upwardly in the inventory or loading position of the unit which effectively permits the mounting of an additional tray assembly within a unit having the same height as that of a conventional fixed header unit. Thus the displaceable header provides for an increase in the capacity of the unit and the product packages or articles displayed therein without increasing the height of the display unit.

The unit includes a series of superposed, pivotably mounted tray assemblies coupled for simultaneous movement between a display position, where articles or packages can be selectively removed by customers, and an inventory or loading position. The header of the rack is hinged upon the frame and is displaced upwardly by a bail to provide access to the support shelf of the uppermost tray assembly when in the loading position. A suitable locking mechanism preferably is provided to maintain the tray assemblies in the preferred inclined positions.

One of the primary objects of the invention is the provision of a gravity-fed loading and display-dispensing rack having a movable header which permits the display of additional articles without increasing the size of the rack.

Another object of the invention is the provision of a display rack having a series of vertically spaced, pivotably mounted, article-supporting tray assemblies wherein the header of the rack is displaced to an out-of-the-way position when the tray assemblies are inclined in the inventory position.

Still another object of the invention is the provision of a display rack which is capable of displaying a greater number of articles of merchandise without increasing the rack size, and which is of durable construction.

Other objects and advantages of the invention will become apparent when considered in view of the following detailed description.

DETAILED DESCRIPTION OF THE INVENTION

Figure 1:
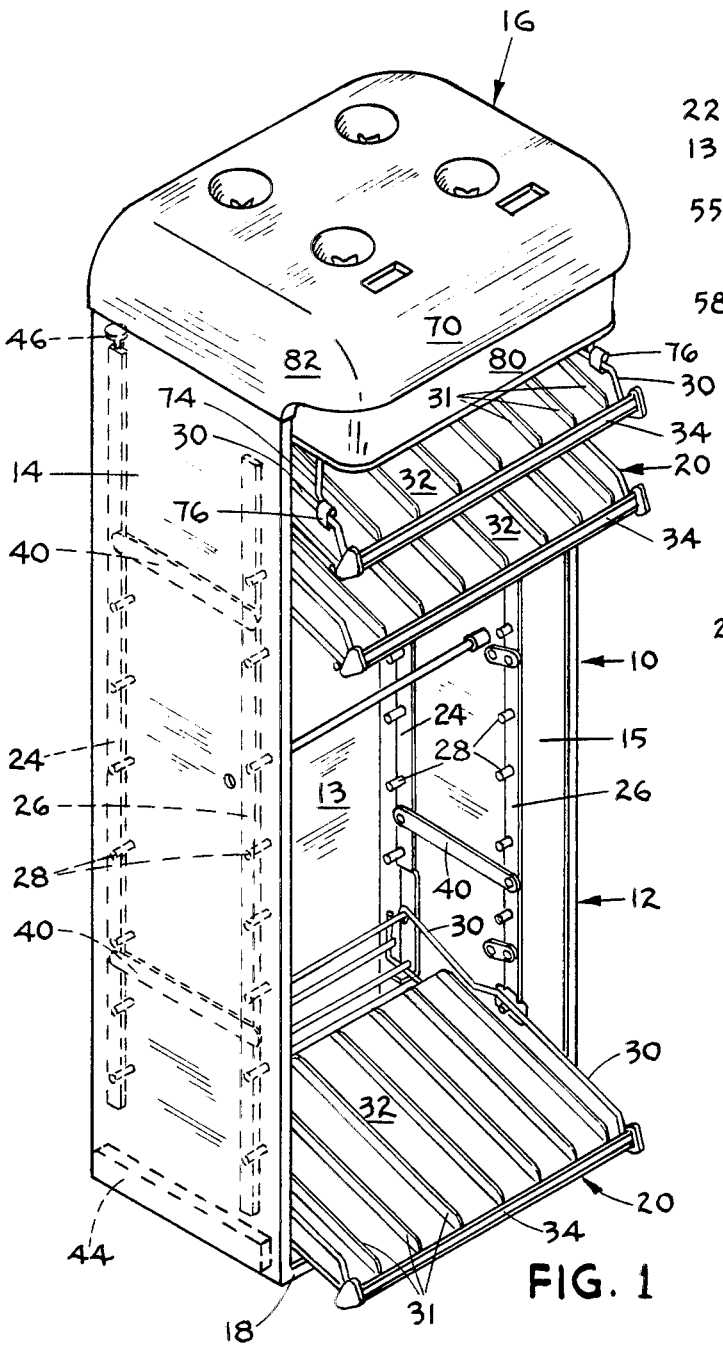
FIG. 1 is a fragmentary perspective view of a display rack made according to the invention wherein the tray assemblies, only a portion of which have been shown, are inclined downwardly in the display and dispensing position.

Referring to the drawings, and particularly to FIG. 1, the display rack, shown generally at 10, is comprised of a frame 12 having a pair of vertical side members 14, 15 attached to a rear wall 13, a header assembly 16, an elevator 17 for the header assembly and a base 18.

Figure 2:
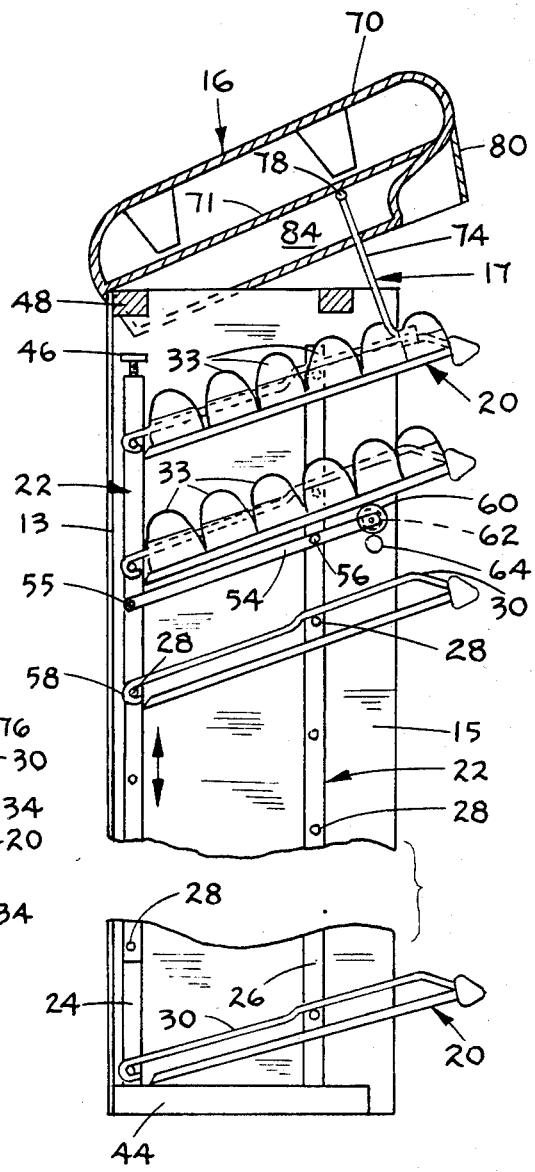
FIG. 2 is a fragmentary side elevational view, with portions removed and partly in section, illustrating the tray assemblies in the inventory or loading position and with the hinged header in a raised position to provide access to the uppermost tray assembly.
Figure 5:
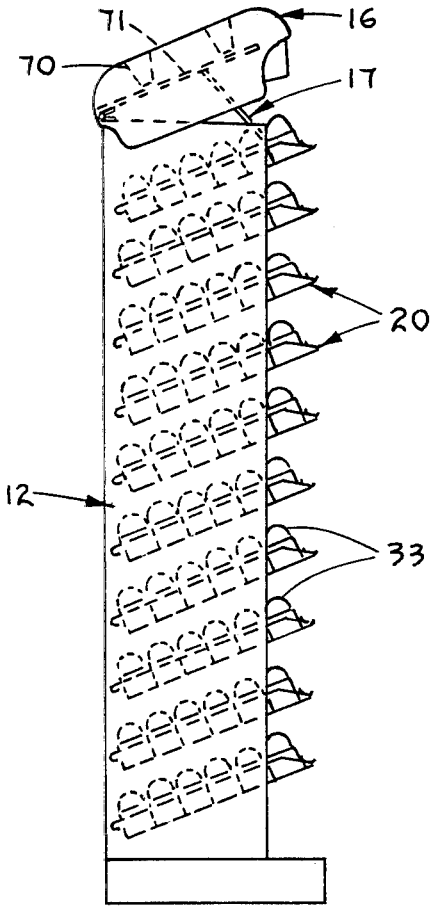
FIG. 5 is a reduced, schematic, side elevational view with the tray assemblies in the inventory position and with the header in the raised position.

A plurality of tray assemblies 20 are movably supported, with respect to frame 12 and base 18, upon a tray-supporting mechanism 22. Each tray assembly, in the embodiment illustrated, includes a wire frame 30 shaped in a configuration as shown by FIGS. 1, 2 and 5, and a shelf or insert 32 mounted thereon. The shelf inserts 32, which may be of plastic construction, are provided with a series of dividers or partitions 31 for defining a series of channels of desired widths to ensure that articles or packages 33 will remain in alignment with one another. A member 34 is secured to the wire frame 30 of each assembly and serves to close the ends of the channels and limit the movement of the articles 33 when the tray assemblies are in the display and dispensing position.

The tray-supporting mechanism 32 includes pairs of spaced, substantially vertical members 24 and 26 positioned adjacent the side members 14, 15. Forwardly positioned vertical members 26 are rigidly fixed to the side members 14, 15 while the rearwardmost pair of vertical members are capable of vertical displacement relative to the side members 14, 15. The vertical members are coupled together by tie members 40 which have opposite end portions pivotably attached to members 24 and 26.

Pins or studs 28 extend inwardly from the members 24, 26 at each side of the unit for supporting the tray assemblies 20. The pins are appropriately positioned and equally spaced, depending upon the number of tray assemblies utilized and the desired spacing between the assemblies 20. As shown most clearly by FIGS. 1 and 2, the rearwardmost portions of a wire frame 30 are hooked over aligned pins 28 provided on the pair of rearwardmost vertical members 24, 24. Intermediate portions of the frame 30 also are supported upon aligned, opposed pins 28 projecting from the forward vertical members 26, 26. The pins on members 26, 26 serve as pivot points for the wire frames 30 of the tray assemblies 20.

Figure 4:
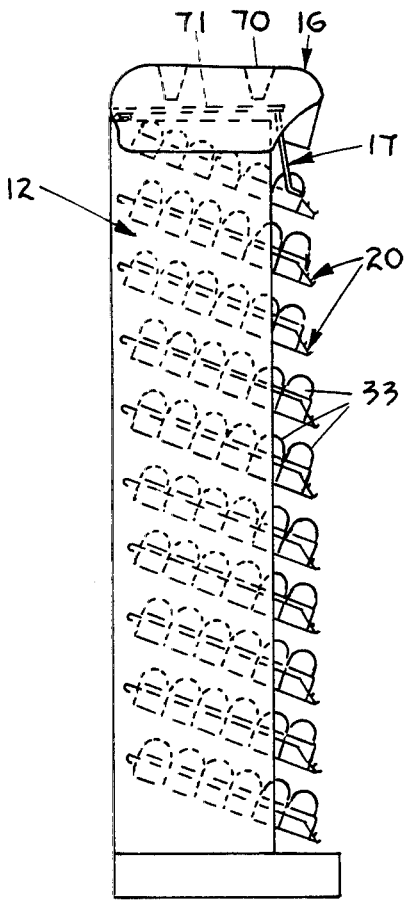
FIG. 4 is a reduced, schematic, side elevational view of the display rack with the trays in the display position.
Figure 3:
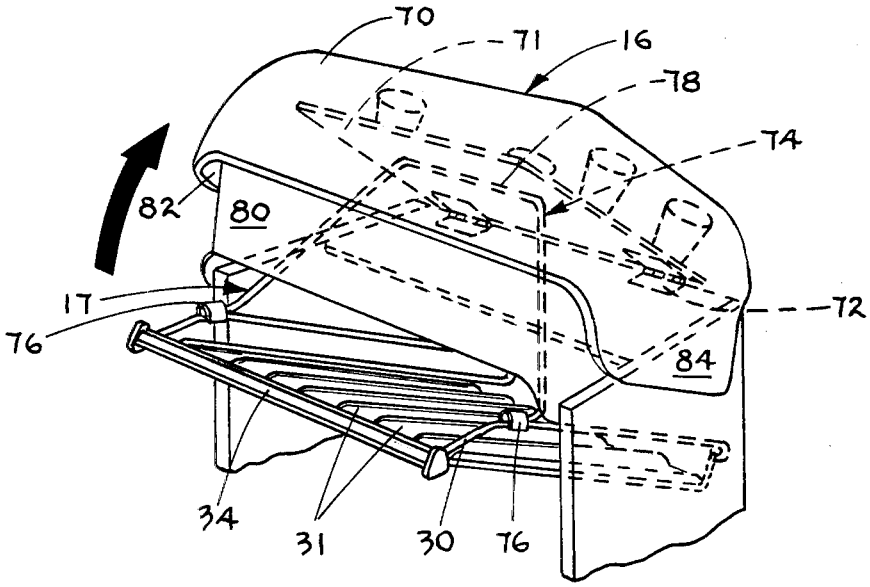
FIG. 3 is a fragmentary perspective view illustrating the header assembly in the inventory position.

Since the tray assemblies 20 are pivotably attached to members 24, 24 which are capable of vertical displacement, and pivot upon pins 28 projecting from the fixed vertical members 26, 26, manual displacement of one tray assembly 20 automatically results in equal displacement of all tray assemblies together as a unit. The tray assemblies are capable of being displaced between the position shown by FIGS. 2, 4 and the position shown by FIGS. 1, 3.

Vertical displacement of members 24, 24 downwardly is limited by stop member 44, 44 positioned at the junctures of the frame side members 14, 15 with the base 18. Upward vertical displacement of members 24, 24 is limited by adjustable stop members 46, 46 mounted upon the upper end of each vertical member 24, 24 and adapted to abut a cross member 48, FIG. 2, which interconnects the two side members 14 and 15. Additional cross members may be provided, if so desired, to interconnect side members 14, 15.

The tray assemblies 20, which move as a unit, may be selectively locked in the loading position or in the dispensing position, as desired, by a conventional locking mechanism. In the embodiment illustrated, the locking mechanism includes an elongated bar 54 pivoted intermediate its length upon a pin 56 attached to a fixed vertical member 26. One end of bar 54 is pivotably attached by pin 55 to the displaceable member 24 while the opposite forward end carries a suitable, conventional fastener 60 having a projecting portion which is adapted to be selectively received in one of upper and lower recessed areas 62, 64 in side wall 15. The safety locking mechanism 54, 60, 62, 64 prevents accidental tilting of the shelf assemblies 20. A similar locking mechanism may also be provided on the opposite side of the display rack if so desired.

Referring to FIGS. 2–5, the hinged header concept effectively permits an additional tray assembly 20 to be provided, over the number of tray assemblies provided on a conventional display rack, without increasing the height of the rack. For example, the number of tray assemblies within a display of a specific height can be increased from nine to ten, thus effectively increasing the storage and display capacity of the product packages.

The header assembly 16 includes a top or cap 70 having a support panel 71 secured thereto, and hinges 72 secured to the panel 71 and the frame 12. The hinges 72 may be fastened to the cross member 48 interconnecting side members 14, 15. The elevator 17, which controls the movement of header cap 70, consists of a metal wire or rod formed into a generally U-shaped bail 74. Opposite end portions of the bail are attached by clips 76 or other suitable fasteners to the wire members 30 of the uppermost tray assembly 20. The fasteners 76 are located near the forward portions of the uppermost tray assembly, and the bail 74 extends upwardly and slightly rearwardly of the uppermost shelf 32 such that the bight 78 of the bail engages the header assembly support panel 71. Thus, it can be seen that manual tilting movement of any one of the tray assemblies towards the inventory or loading position, FIGS. 2, 4, results in displacement of the upper tray assembly which lifts the bail 74 such that the bight thereof abuts panel 71, pivoting the cap 70 upwardly about the hinges 72. As the trays are tiled to the position of FIGS. 1 and 3, the bail 74 is lowered and gravity urges the cap 70 to the FIG. 1 position.

It is to be noted that the top or cap 70 may be of plastic construction and includes a front section 80 and side sections 82, 84 which depend from the upper portions of the side panels 14 and 15. Section 80 may serve as a support for point-of-sale advertising materials.

The display rack 10 may be constructed of various suitable materials and may be of various widths, as desired, depending upon need.

What is claimed is:

1. A gravity-fed product display rack comprising a frame, support means cooperating with said frame, a plurality of superposed tray assemblies carried by said support means and movable between a downwardly inclined product package display and dispensing position and an upwardly inclined product package loading position, a header assembly mounted upon said frame for displacement relative thereto, and elevator means secured to one of said plurality of superposed tray assemblies for controlling the displacement of said header assembly relative to said frame as said tray assemblies are displaced between upwardly and downwardly inclined positions.

2. A rack as recited in claim 1, said support means including a pair of vertically disposed members fixedly secured to said frame and a pair of movable vertically disposed members mounted for vertical displacement relative to said frame, coupling means interconnecting said pairs of vertically disposed members, and means pivotably mounting said tray assemblies upon said fixed and said movable vertically disposed members.

3. A rack as recited in claim 2, each tray assembly including a shelf having dividers for defining a plurality of parallel channels, said channels corresponding generally in width to the width of product packages to be displayed and dispensed.

4. A rack as recited in claim 1, wherein said elevator means includes a wire bail mounted upon the uppermost tray assembly.

5. A gravity-fed product display rack comprising a frame, a plurality of superposed tray assemblies, means coupled to said frame for supporting said tray assemblies for pivotable displacement between first and second inclined positions, a header assembly hingedly mounted upon said frame, and elevator means attached to one of said plurality of superposed tray assemblies for controlling the position of said header assembly as said tray assemblies are displaced between said first and second positions.

6. A display rack as recited in claim 5, wherein said elevator means includes an upstanding, angularly disposed member secured to the uppermost assembly of said plurality of tray assemblies and engaging said header assembly.

7. A display rack as recited in claim 6, wherein said angularly disposed member comprises a bail.

8. A display rack as recited in claim 5, wherein in said first inclined position, said tray assemblies are inclined downwardly for displaying product packages and facilitating dispensing of product packages therefrom, and in said second inclined position said tray assemblies are inclined upwardly for facilitating the loading of product packages on said tray assemblies.

9. A display rack as recited in claim 7, wherein said bail is selectively positioned to lift said header assembly when said tray assemblies are in the second inclined position to provide unobstructed access to said uppermost tray assembly, and to lower said header assembly as said tray assemblies are pivoted to said first inclined position.

* * * * *